US010874894B2

(12) United States Patent
An

(10) Patent No.: US 10,874,894 B2
(45) Date of Patent: Dec. 29, 2020

(54) FITNESS EQUIPMENT

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 20 days.

(21) Appl. No.: 16/213,077

(22) Filed: Dec. 7, 2018

(65) Prior Publication Data

US 2019/0175973 A1 Jun. 13, 2019

(30) Foreign Application Priority Data

Dec. 11, 2017 (KR) ..... 10-2017-0169674

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 23/035*** | (2006.01) |
| ***A63B 23/12*** | (2006.01) |
| ***A63B 21/068*** | (2006.01) |
| *A63B 23/00* | (2006.01) |

(52) U.S. Cl.

CPC .... *A63B 21/0428* (2013.01); *A63B 21/00043* (2013.01); *A63B 21/00065* (2013.01); *A63B 21/00185* (2013.01); *A63B 21/0442* (2013.01); *A63B 21/0552* (2013.01); *A63B 21/068* (2013.01); *A63B 21/4035* (2015.10); *A63B 23/03533* (2013.01); *A63B 23/12* (2013.01); *A63B 23/1236* (2013.01); *A63B 23/1254* (2013.01); *A63B 21/0557* (2013.01); *A63B 2023/006* (2013.01)

(58) Field of Classification Search

CPC ..... A63B 21/00043; A63B 21/00065; A63B 21/0442; A63B 21/0552; A63B 21/0557; A63B 21/068; A63B 21/4035; A63B 23/1236; A63B 23/1254; A63B 23/12; A63B 23/02; A63B 2023/006

See application file for complete search history.

(56) References Cited

U.S. PATENT DOCUMENTS 3,592,467 A * 7/1971 Pereira ..... A63B 21/0004 482/126
4,225,132 A * 9/1980 Archambault ..... A63B 21/0004 482/125

(Continued)

FOREIGN PATENT DOCUMENTS

| | | |
|---|---|---|
| CN | 2079064 U | 6/1991 |
| CN | 204050776 U | 12/2014 |
| CN | 206391455 U | 8/2017 |

OTHER PUBLICATIONS

Chinese Office Action dated Apr. 15, 2020.

*Primary Examiner* — Megan Anderson
(74) *Attorney, Agent, or Firm* — Rabin & Berdo, P.C.

(57) ABSTRACT

A fitness equipment includes two handles each including a gripping part gripped by hands and an elastic member-coupling part to which an end portion of an elastic member configured to extend between the two handles is coupled; and a supporting base provided with a supporting surface provided at a location opposite the gripping part of the handle, and supported on a bottom surface, wherein the handle and supporting base assemblies are used to perform push-up exercises, and the elastic member is coupled between the two handles to perform chest expander exercises.

3 Claims, 7 Drawing Sheets

(56) References Cited

U.S. PATENT DOCUMENTS

| | | | | |
|---|---|---|---|---|
| 8,152,703 | B1 * | 4/2012 | Hinds | A63B 21/00065 482/122 |
| 9,155,934 | B2 * | 10/2015 | Kassel | A63B 21/0414 |
| 2013/0316882 | A1 * | 11/2013 | Param | A63B 21/4013 482/125 |
| 2017/0028243 | A1 * | 2/2017 | Chuang | B32B 5/08 |
| 2019/0143168 | A1 * | 5/2019 | Chang | A63B 21/4035 482/138 |

* cited by examiner

FITNESS EQUIPMENT

CROSS-REFERENCE TO RELATED APPLICATION

This application claims priority to and the benefit of Korean Patent Application No. 2017-0169674, filed on Dec. 11, 2017, the disclosure of which is incorporated herein by reference in its entirety.

BACKGROUND

1. Field of the Invention

The present disclosure relates to fitness equipment, and more specifically, to fitness equipment having multiple functions which allow push-up exercises and chest expander exercises to be performed through one piece of fitness equipment.

2. Discussion of Related Art

Weigh training is performed as a method of improving muscular strength and muscular endurance of various body parts, and reducing body fat to improve health.

A representative exercise using the own weight of a user instead of equipment among the weight training is the push-up exercise. The push-up exercise is performed by bending and stretching arms in a state in which both arms are placed on a bottom surface and feet are supported by the bottom surface. A method of increasing exercise intensity of the push-up exercise may be performed by maximally lowering a chest toward the ground, and since the chest cannot be lowered to a level equal to or under a part on which hands are placed, push-up bars are used to further increase the exercise intensity.

Since the push-up bars have a structure in which a handle is located and maintained at a predetermined height from the bottom surface, when the push-up is performed using the push-up bars, the pectoralis major can be further stimulated to increase the exercise intensity because the chest can be lowered to a level lower than the handle, and wrist joints can be protected because the push-up is performed in a state in which the handle is held.

Meanwhile, a chest expander is provided as fitness equipment configured to exercise pectoral muscles and arm muscles, as with the push-up bar. The chest expander is formed of a pair of gripping parts and an elastic body connected between the pair of gripping parts, and is a piece of fitness equipment configured to impart muscular strength to the arms, the chest, or shoulders by pulling outward in a state in which the user grips the pair of gripping parts with both hands.

However, the push-up bars or the chest expander are separate pieces of fitness equipment of which exercise methods are different from each other, and each can be used for only one purpose. Accordingly, the push-up bars and the chest expander should be separately provided to perform both the push-up exercise and the chest expander exercise.

SUMMARY OF THE INVENTION

The present disclosure is directed to providing fitness equipment having multiple functions to be used for purposes of chest expander exercises and push-up exercises.

According to an aspect of the present disclosure, there is provided fitness equipment including two handles each including a gripping part gripped by hands and an elastic member-coupling part to which an end portion of an elastic member configured to extend between the two handles is coupled; and a supporting base provided with a supporting surface provided at a location opposite the gripping part of the handle, and supported on a bottom surface.

The fitness equipment may include the elastic member having both ends respectively coupled to elastic member-coupling parts and configured to extend in a longitudinal direction between the two handles to perform chest expander exercises.

The handle may include supporting parts configured to extend from both ends of the gripping part in a direction which crosses the gripping part, and the elastic member-coupling part may be disposed across both supporting parts.

The supporting base may be detachably coupled to a lower end portion of the supporting part, a coupling groove to which the lower end portion of the supporting part is insertion-fixed may be formed in an upper portion of the supporting base, and the supporting base may be attachable to or detachable from the coupling groove in a manner in which lower end portion of the supporting part is inserted to be fixed or separated.

The supporting base may be integrally formed so as not to be separated from the handle.

The elastic member may be formed in a wire shape to which a stopper member is coupled to an end portion thereof, a fixing hole into which the elastic member is inserted, and configured to support the stopper member to prevent separation of the elastic member may be formed in the elastic member-coupling part, and an incised part configured to extend from the fixing hole to serve as a path through which the elastic member is attached and detached may be formed in one side surface of the elastic member-coupling part.

The elastic member-coupling part may be formed in a bar shape in which a space which is open to one side, the fixing hole may be formed at an opposite side of a side facing the gripping part from the elastic member-coupling part, and since the incised part is formed to extend from the fixing hole to an opening along a side surface of the elastic member-coupling part, the elastic member may be detachable through the incised part, and a stopper member of the elastic member may be located in the space to be maintained without separation from the fixing hole.

The elastic member may be formed in a tube shape having a hollow hole, and may have the stopper member inserted into the elastic member at the end portion of the tube-shaped elastic member and having an outer diameter greater than an inner diameter of the hollow hole of the elastic member and the fixing hole.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
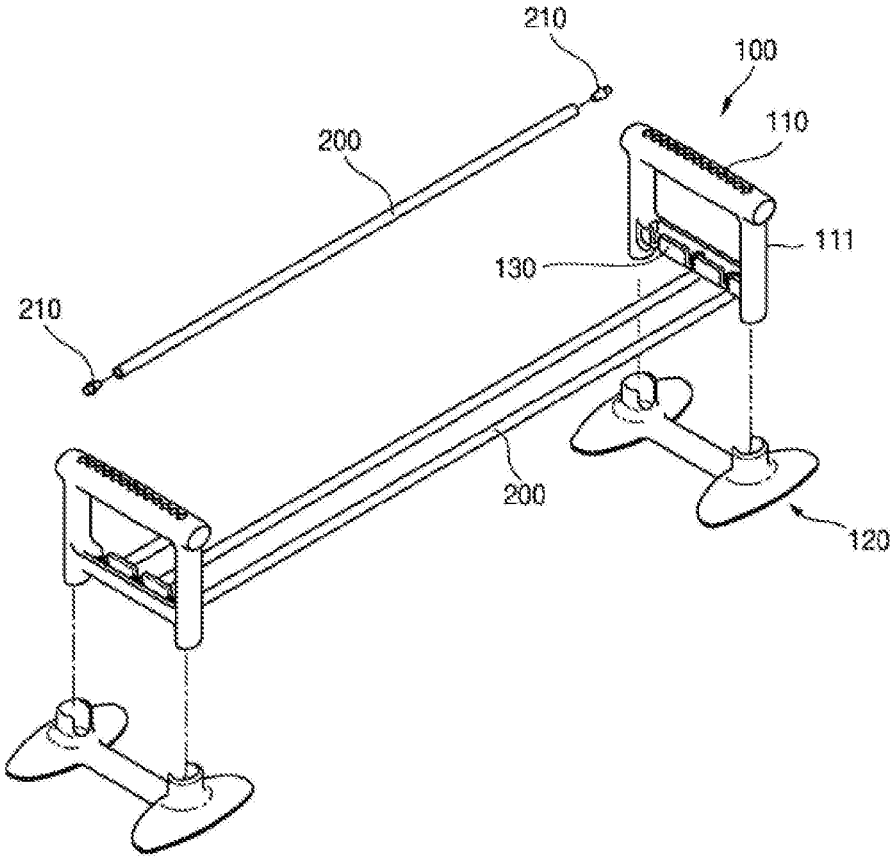
FIG. 1 is an exploded perspective view of fitness equipment according to an embodiment of the present disclosure.

Since the present disclosure may be variously changed and have various embodiments, particular embodiments will be exemplified in the drawings and described. However, the present disclosure is not limited to the particular embodiments and includes all changes, equivalents, and substitutes falling within the spirit and the scope of the present disclosure. Similar reference numerals are used for similar elements in a description of the drawings.

The terms are only used to distinguish one element from another. Terms used in the present disclosure are just used to describe the particular embodiments, and not to limit the present disclosure. The singular form is intended to also include the plural form, unless the context clearly indicates otherwise.

Hereinafter, embodiments will be described in detail with reference to the accompanying drawings.

Figure 2:
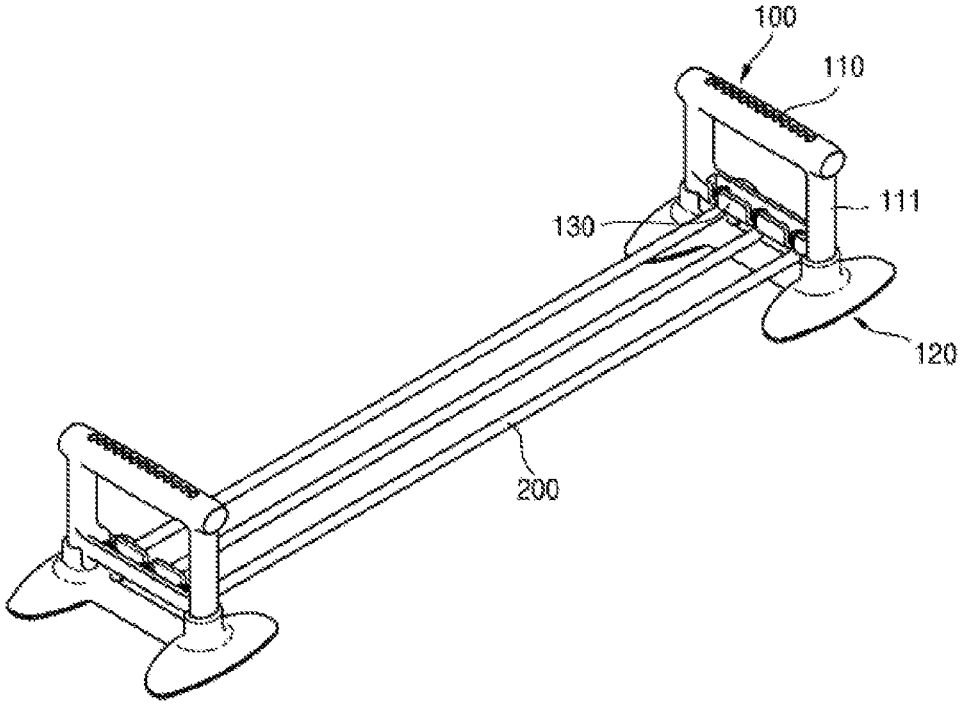
FIG. 2 is a combined perspective view of the fitness equipment according to the embodiment of the present disclosure.
Figure 3:
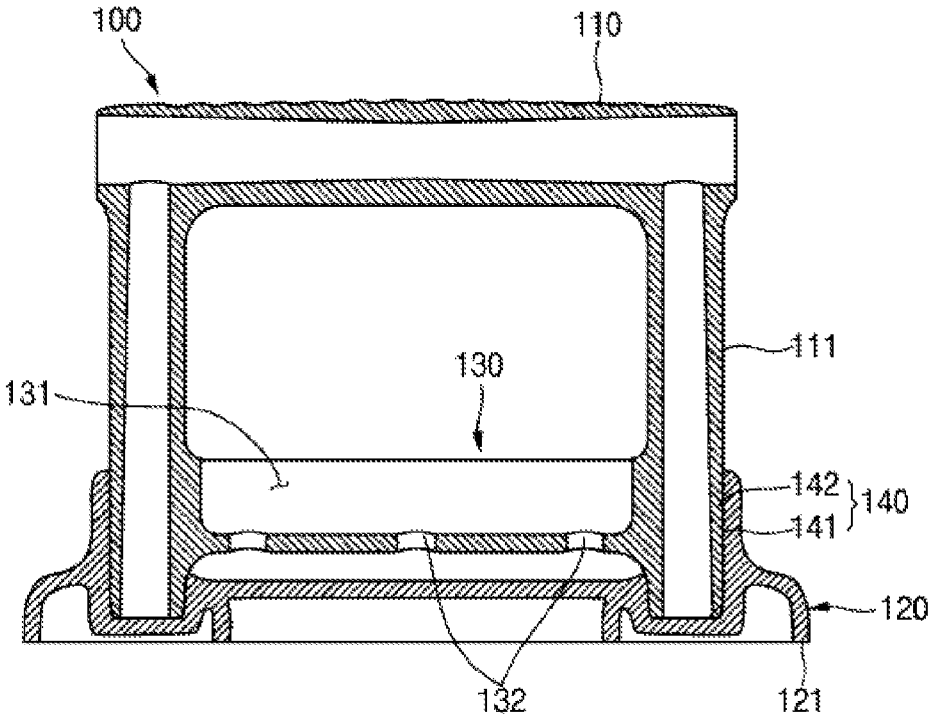
FIG. 3 is a cross-sectional view of a handle of the fitness equipment according to the embodiment of the present disclosure.
Figure 4:
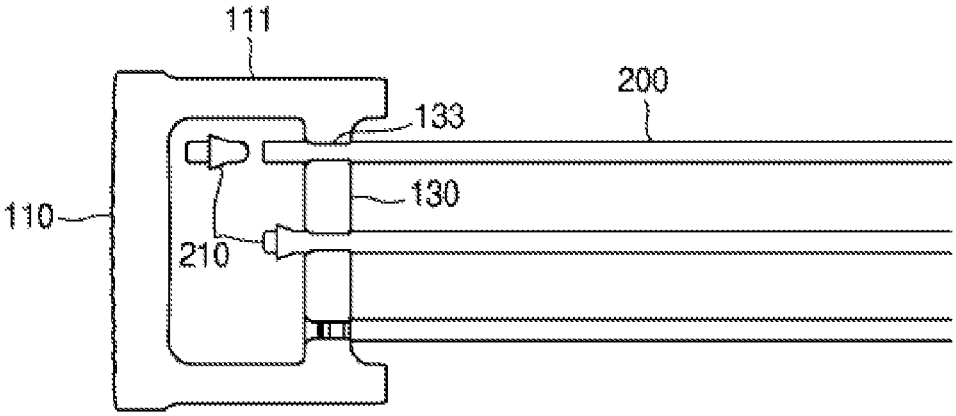
FIG. 4 is a view for describing a principle in which a tube-shaped elastic member is fixed to an elastic member-coupling part of the fitness equipment according to the embodiment of the present disclosure.
Figure 5:
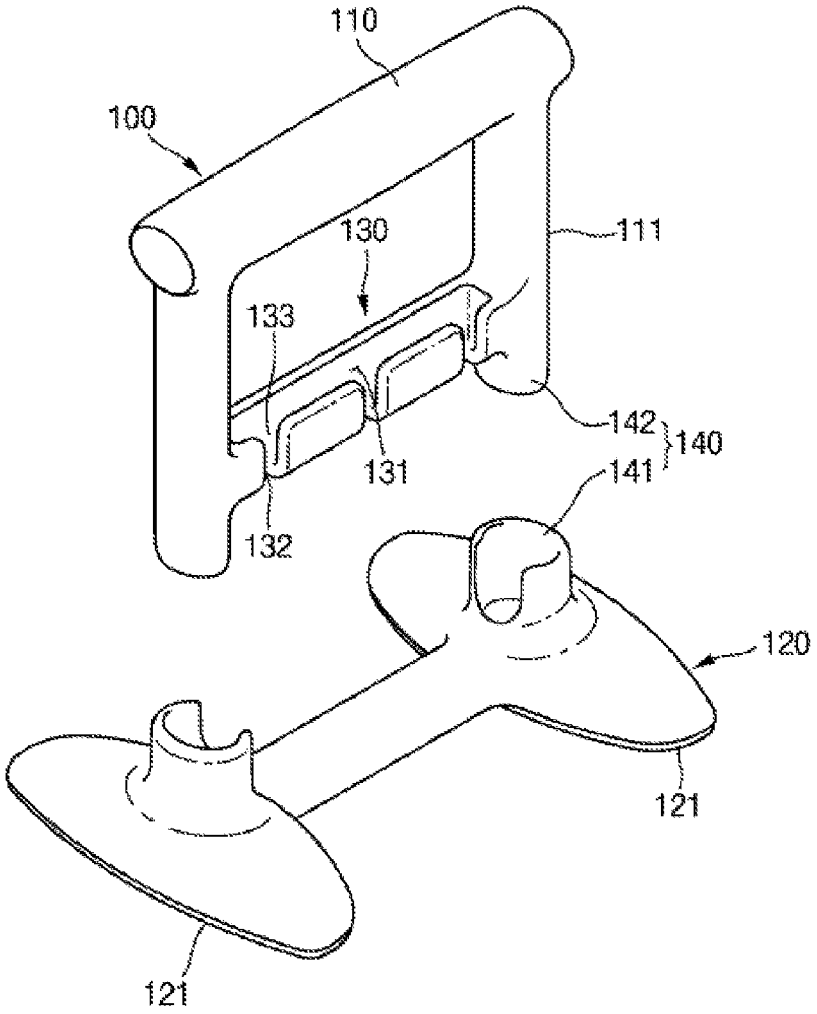
FIG. 5 is an exploded perspective view of the handle of the fitness equipment according to the embodiment of the present disclosure.

FIGS. 1 and 2 are an exploded perspective view and a combined perspective view of fitness equipment according to an embodiment of the present disclosure, respectively, FIG. 3 is a cross-sectional view of a handle of the fitness equipment according to the embodiment of the present disclosure, FIG. 4 is a view for describing a principle in which a tube-shaped elastic member is fixed to an elastic member-coupling part of the fitness equipment according to the embodiment of the present disclosure, FIG. 5 is an exploded perspective view of the handle of the fitness equipment according to the embodiment of the present disclosure.

Referring to the accompanying drawings, the fitness equipment according to the embodiment of the present disclosure includes two handles 100, a supporting base 120 coupled to each of the handles 100, and elastic members 200 coupled between the two handles 100.

The fitness equipment according to the present disclosure includes a pair of left and right handles 100, that is, the two handles 100 so that an exerciser may exercise chest muscles and arm muscles through push ups or chest expanding while gripping the fitness equipment with both hands.

According to the embodiment of the present disclosure, the handle 100 includes a gripping part 110, supporting parts 111, and an elastic member-coupling part 130, and the supporting base 120 is detachably coupled to the handle 100.

On the basis of FIGS. 1 and 2, the handle 100 has the gripping part 110 gripped by the hand of the exerciser at an upper side, and the supporting base 120 supported on a bottom surface is coupled to a lower side of the handle 100.

The gripping part 110 has an elliptical cross-sectional surface to be conveniently gripped by the hand of the exerciser, and the inside of the gripping part 110 may be formed to be hollow.

The gripping part 110 includes the supporting parts 111 configured to extend toward the supporting base 120 in a direction which crosses the gripping part 110 at both ends thereof.

The supporting parts 111 are detachably coupled to the supporting base 120, and lower end portions 142 of the supporting parts 111 are coupled in a manner of being insertion-fixed to coupling grooves 141 formed in an upper surface of the supporting base 120. The lower end portions 142 of the supporting parts 11 and the coupling grooves 141 of the supporting base 120 form a coupling part 140 in which the handle 100 and the supporting base 120 interact to form a coupling force. That is, the handle 100 and the supporting base 120 may be integrally coupled through the coupling part 140.

As shown in FIG. 3, the supporting part 111 may be formed in a shape having a hollow hole.

The supporting base 120 includes a supporting surface 121 which is in contact with the bottom surface such as the ground or the like to be supported at a lower portion thereof.

The supporting surface 121 has a broadly formed portion located under the coupling groove 141, and may be formed in a dumbbell shape of which a connection portion between portions located under the coupling groove 141 is formed to be relatively narrow. Accordingly, the supporting base 120 may be broadly supported on the ground through the supporting surface 121 to provide stability during the push-up exercise and the elastic member 200 may be minimally interfered with by the supporting base 120 even when the chest expander exercise is performed without separating the supporting base 120 from the handle 100.

Further, a plurality of protrusions (not shown) configured to prevent easy movement of the fitness equipment during the push-up exercise using the assembly of the handle 100 and the supporting surface 120 by increasing a coefficient of friction between a bottom surface of the supporting surface 121 and the ground may be formed in the bottom surface of the supporting surface 121, and a friction pad and the like may be coupled to the bottom surface of the supporting surface 121.

The elastic member-coupling part 130 is formed across the space between the supporting parts 111 of the handle.

According to the embodiment of the present disclosure, the elastic member may be a tube-shaped elastic member having a hollow hole, and the elastic member-coupling part 130 may be formed so that both ends of the tube-shaped elastic member may be conveniently fixed and released. That is, according to the embodiment of the present disclosure, the elastic member 200 may be formed in a wire shape which extends in a longitudinal direction, and may be formed in a tube shape of which the inside is formed to be hollow. Since a stopper member 210 is coupled to an end portion of the tube-shaped elastic member 200, the end portion of the elastic member 200 may be engaged with fixing holes 132 formed in the elastic member-coupling part 130 to be easily detachable.

According to the embodiment of the present disclosure, at least one elastic member 200 is disposed between the pair of left and right handles 100, and both ends of the elastic member 200 are fixed to the elastic member-coupling part 130 of the handle 100.

The elastic member-coupling part 130 is formed in a bar shape which integrally extends between inner side surfaces of both side supporting parts 111. Further, the elastic member-coupling part 130 may be formed in a bar shape having a space 131 of which a side toward the gripping part 110 is open, a plurality of fixing holes 132 to which the end portion of the elastic member 200 may be fixed in a direction opposite a direction toward the gripping part 110, that is, in a direction in which the supporting base 120 is formed, may be formed to pass through the elastic member-coupling part 130.

Accordingly, when the stopper member 210 is inserted through the end portion of the elastic member 200 after inserting the tube shaped elastic member 200 in a direction of the gripping part 110 through the fixing holes 132, the end portion of the elastic member 200 may be engaged with and supported in the fixing holes 132 in a state in which the stopper member 210 is located in the vacant space 131.

The stopper member 210 has a wedge shape which is press-inserted into holes in both ends of the tube-shaped elastic member 200 to enlarge an outer diameter of the tube 200, and has an outer diameter greater than that of the fixing hole 132. Since the elastic member 200 is engaged with the fixing holes 132 by the stopper member 210, both ends of the elastic member 200 are not separated from the elastic member-coupling part 130. However, the stopper member 210 is not limited to the wedge shape, fixing holes 132, and various shaped members each having an outer diameter greater than that of the fixing hole 132 such as a spherical shape a diameter greater than that of the fixing hole 132 and the like may be used.

When the wedge-shaped stopper member 210 is described in detail with reference to FIG. 4, the stopper member 210 may be formed in a shape of which a diameter decreases from both ends of the elastic member 200 to the inside of the holes. Accordingly, the stopper member 210 is easy to be inserted into the holes of the elastic member 200, but is difficult to be separated from the tube holes of the elastic member 200. When the stopper member 210 is insertion-fixed to the tube holes of the elastic member 200, the portion into which the stopper member 210 of the elastic member 200 is inserted has a diameter greater than that of the fixing hole 132, and the elastic member 200 is not separated from the fixing hole 132 of the elastic member-coupling part 130 even when the elastic member 200 receives a force in a direction in which the elastic member 200 stretches, that is, the chest expander exercise is performed.

According to the embodiment of the present disclosure, an incised part 133 configured to extend from the fixing hole 132 to an opening of the elastic member-coupling part 130 is formed in one side surface of the elastic member-coupling part 130.

Fitting or separating the elastic member 200 to which the stopper member 210 is insertion-fixed through the incised part 133 to or from the fixing hole 132 may be easily performed. Accordingly, when the user desires to use the push-up bar in a state in which the elastic members 200 are separated from the fitness equipment according to the embodiment of the present disclosure, the elastic member 200 may be easily separated from the elastic member-coupling part 130.

Since the incised part 133 becomes a moving path of a portion of the elastic member 200 to which the stopper member 210 is not coupled, a width of the incised part 133 may be formed to be smaller than a diameter of the stopper member 210, and may be formed to be the same as a diameter of the fixing hole 132.

Further, according to the embodiment of the present disclosure, since the elastic member-coupling part 130 has the plurality of fixing holes 132 and the incised parts 133 configured to extend from the fixing holes 132, the elastic member 200 may be easily attached and detached. Accordingly, the user may easily adjust the number of elastic members 200 which will be coupled to the elastic member-coupling part 130 to adjust the intensity of a force necessary for the chest expander exercise using the elastic member 200. That is, the user may adjust the tension of the chest expander using a method of increasing or decreasing the number of elastic members 200.

A method of using the fitness equipment according to the embodiment of the present disclosure will be described.

As shown in FIG. 2, when the supporting base 120 is disposed to be supported on the bottom surface in a handle supporting base assembly state in which the handle 100 and the supporting base 120 are coupled to each other, the user may perform the push-up exercise using the handle supporting base assembly as the push-up bar. Although the elastic member 200 is shown to be coupled between the handle supporting base assemblies at both sides thereof in FIG. 2, as shown in the embodiment of the present disclosure, since the elastic member 200 is easily separable from the handles, the push-up exercise may be performed in a state in which the elastic member 200 is separated.

Figure 6:
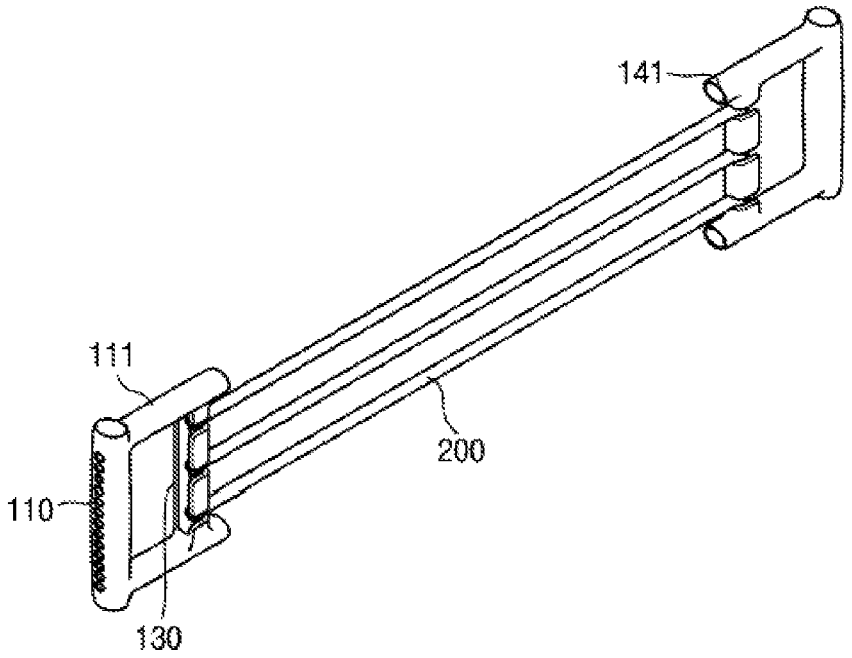
FIG. 6 is a perspective view illustrating a state in which the fitness equipment according to the embodiment of the present disclosure is used as a chest expander.

FIG. 6 is a view illustrating a state in which the supporting base 120 is separated from the handle 100 in the fitness equipment according to the embodiment of the present disclosure. As shown in FIG. 6, the chest expander exercise in which both handles 100 are spread by holding both handles 100 and applying a force to both handles 100 in a state in which the supporting bases 120 are separated is performable. In this case, since the elastic member 200 is easily detachable from the handle, an exercise suitable for muscle power of the user is performable by adjusting the number of elastic members 200 to adjust the tension.

Fitness equipment according to another embodiment of the present disclosure will be described with reference to FIG. 7. Hereinafter, in a description of the fitness equipment according to another embodiment of the present disclosure, the same names and reference numerals are used for the elements having the same functions as those of the embodiment of the present disclosure, and detailed descriptions of the elements will be omitted to avoid repetitive elements.

Figure 7:
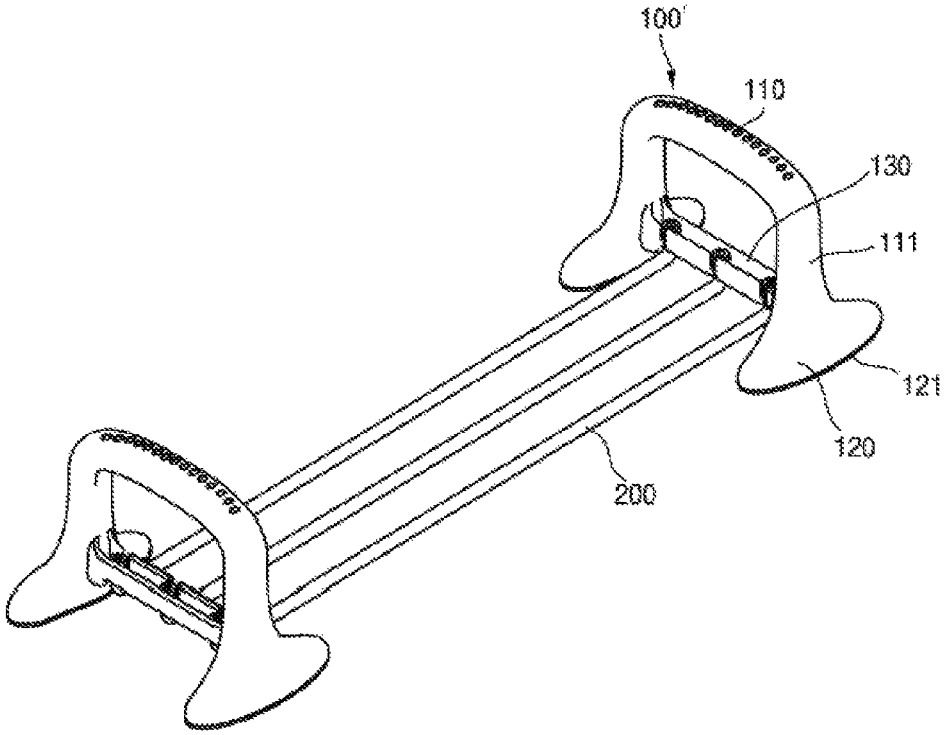
FIG. 7 is a perspective view illustrating fitness equipment according to another embodiment of the present disclosure.

Referring to FIG. 7, in a handle 100' according to another embodiment of the present disclosure, a gripping part 110, a supporting part 111, an elastic member-coupling part 130, and a supporting base 120 are integrally formed. Since the supporting base 120 is integrally formed with the supporting part 111 as an element of the handle 100', the handle according to another embodiment of the present disclosure shown in FIG. 7 refers to the single handle 100' to be distinguished from the handle described with reference to FIG. 1.

In the single handle 100', since the supporting base 120 is integrally formed as one element of the single handle 100', a fixing part for attaching and detaching the supporting base 120 is not formed unlike an embodiment of the present disclosure.

In the single handle 100', a connection member which crosses the supporting surface 121 forming the supporting base 120 under the elastic member-coupling part 130 may be omitted contrary to an embodiment of the present disclosure.

As shown in FIG. 7, the push-up exercise may be performed in a state in which the supporting surface 121 of the single handle 100' is disposed facing the bottom surface and the user grips the gripping parts 110 of both single handles 100'. That is, the single handle 100' becomes the push-up bar. In this case, as shown in an embodiment of the present disclosure, the user may perform the push-up exercise in a state in which the elastic member 200 is separated.

Meanwhile, when the user performs the chest expander exercise, in a state shown in FIG. 7, the single handles 100' are laid down so that both gripping parts 110 are located opposite each other, and the single handles 100' are pulled.

The fitness equipment according to another embodiment of the present disclosure shown in FIG. 7 does not requires an operation of separating the supporting base 120 during a change between the push-up exercise and the chest expander exercise.

As described above, since the fitness equipment according to the present disclosure may be used for both the chest expander and the push-up bar, one piece of fitness equipment may be used for two purposes.

Both push-up exercises and chest expander exercises can be used using the fitness equipment according to the present disclosure. That is, one piece of fitness equipment can be used for two purposes.

Further, according to the present disclosure, since an elastic member is easily detachable from a handle, tension can be easily adjusted, the push-up exercise can be performed in a state in which the elastic member is separated, the chest expander exercise can be performed in a state in which the elastic member is coupled, and the push-up exercise can be performed in the state in which the elastic member is coupled according to a choice of a user.

As described above, although the present disclosure is described in detail with exemplary embodiments, the present disclosure is not limited to the above-described embodiments, changes may be made within the scope of each of the claims, detailed descriptions, and the accompanying drawings, and the above may be included in the present disclosure.

What is claimed is:

1. A fitness equipment for both push-up exercises and chest expander exercises, comprising:

two handles, each of the two handles including:

a gripping part gripped by a hand of a user;

supporting parts extending downward from both ends of the gripping parts; and an elastic member-coupling part extending between the supporting parts and being disposed below the gripping parts, a plurality of elastic members, each of the plurality of elastic members having a first end coupled to the elastic member-coupling part of one of the two handles and a second end coupled to the elastic member-coupling part of another of the two handles, such that each of the plurality of elastic members extends between the two handles; and two supporting bases, each of the two supporting bases being detachably coupled to lower ends of the supporting parts of each of the two handles, each of said two supporting bases being provided with a supporting surface to be in contact with a ground; wherein each of the elastic member-coupling parts is formed in a bar shape and has two lateral sides and a bottom between the two lateral sides, with a space open toward the respective gripping part being defined collectively by the lateral sides and the bottom, wherein a plurality of fixing holes and a plurality of incised parts are provided in each of the elastic member-coupling parts, wherein each of the plurality of fixing holes is formed at the bottom of a corresponding one of the elastic member-coupling parts, an end part of a corresponding one of the plurality of elastic members passing through each of the plurality of fixing holes to be coupled to each of the elastic member-coupling parts, wherein each of the plurality of incised parts is formed at one of the two lateral sides and extends from a corresponding one of the plurality of fixing holes to a top end of said one of the two lateral sides to be open toward the respective gripping part, each of said plurality of incised parts being a path through which a corresponding one of the plurality of elastic members is attachable to and detachable from the corresponding one of the plurality of fixing holes, and wherein stopper members are provided and connected, respectively, to the first and second ends of each of the plurality of elastic members, each of the stopper members being located in the spaces formed by the elastic member-coupling parts to maintain each of the plurality of elastic members to be coupled to the two handles.

2. The fitness equipment of claim 1, wherein:

a coupling groove, to which a lower end portion of each of the supporting parts is insertion-fixed, is formed in an upper portion of each of the two supporting bases; and the two supporting bases are attachable to or detachable from the supporting parts in a manner in which the lower end portion of each of the supporting parts is inserted into or separated from each of the coupling grooves.

3. The fitness equipment of claim 1, wherein:

the plurality of elastic members are formed in a tube shape having a hollow hole, and each of said stopper members has an outer diameter greater than an inner diameter of the plurality of fixing holes, and is inserted into the hollow hole of the respective plurality of elastic members at the first and second ends thereof.

* * * * *